US007719472B2

(12) United States Patent
Kanemura et al.

(10) Patent No.: US 7,719,472 B2
(45) Date of Patent: May 18, 2010

(54) ANTENNA UNIT, WIRELESS COMMUNICATION STRUCTURE, AND ANTENNA STRUCTURE

(75) Inventors: Tomohiko Kanemura, Kyoto (JP); Takeshi Fujiwara, Kyoto (JP)

(73) Assignee: Suncall Corporation (JP)

( * ) Notice: Subject to any disclaimer, the term of this patent is extended or adjusted under 35 U.S.C. 154(b) by 366 days.

(21) Appl. No.: 11/754,613

(22) Filed: May 29, 2007

(65) Prior Publication Data

US 2007/0279293 A1 Dec. 6, 2007

(30) Foreign Application Priority Data

May 31, 2006 (JP) ..... 2006-151296
Apr. 25, 2007 (JP) ..... 2007-115811

(51) Int. Cl.
*H01Q 1/24* (2006.01)

(52) U.S. Cl. ..... 343/702

(58) Field of Classification Search ..... 343/702, 343/700 MS, 795, 572.7
See application file for complete search history.

(56) References Cited

U.S. PATENT DOCUMENTS 5,119,353 A * 6/1992 Asakura ..... 369/13.01
7,277,017 B2 * 10/2007 Baba et al. ..... 340/572.7
7,323,994 B2 * 1/2008 Yamagajo et al. ..... 340/572.7
7,378,970 B2 * 5/2008 Hayashi et al. ..... 340/572.7
7,378,972 B2 * 5/2008 Kai et al. ..... 340/572.7
7,408,467 B2 * 8/2008 Kai ..... 340/572.7

FOREIGN PATENT DOCUMENTS

| | | |
|---|---|---|
| JP | H10-334198 | 12/1998 |
| JP | 2000-132945 | 5/2000 |
| JP | 2005-190514 | 7/2005 |
| JP | 2007-166573 | 6/2007 |

OTHER PUBLICATIONS

Office Action for priority Japanese Patent Application No. 2007-115811 to Katsuhito Suzuki, mailed on Jul. 18, 2008, 4 pages.

* cited by examiner

*Primary Examiner*—Huedung Mancuso
(74) *Attorney, Agent, or Firm*—Sterne, Kessler, Goldstein & Fox P.L.L.C.

(57) ABSTRACT

There is provided an antenna unit including a non-conductive base film, an endless conductive flat plate member attached onto one surface of the base film and having an opening in a center thereof, and an antenna attached to the one surface of the base film so as to be positioned in the opening of the conductive flat plate member with a gap formed between the antenna and an inner circumferential edge of the conductive flat plate member.

12 Claims, 11 Drawing Sheets

(a)

(b)

(a)

(b)

(a)

(b)

(a)

(b)

(a)

(b)

ANTENNA UNIT, WIRELESS COMMUNICATION STRUCTURE, AND ANTENNA STRUCTURE

BACKGROUND OF THE INVENTION

1. Field of the Invention

The present invention relates to an antenna unit used by being attached to a body that is to be detected such as a CD-ROM or a DVD-ROM including a conductive member. A wireless communication structure equipped with the body includes the conductive member and an antenna that is attached to the body, and an antenna structure applied to the body includes the conductive member and a non-conductive member.

2. Related Art

A disc changer is known as a device for managing/searching a body to be detected such as a disc shaped recording medium like a CD-ROM or a DVD-ROM. However, since the disc changer is configured to identify the recording medium by an arrangement order etc. of the recording medium, it is not possible to search the recording medium while checking the content of the same with the disc changer. Furthermore, the number of recording media to be accommodated is defined in the disc changer, and thus a great number of recording media cannot be handled.

In particular, there are many cases to save various records as electronic data in recent years, and the amount of such data has been becoming a vast amount. Therefore, a great number of recording media must be kept, and it is needed to rapidly and reliably perform inventory management, housing management, access management, or search for managed and kept recording media with respect to such a great number of recording media.

There is another known configuration used in collection management of books or the like. The configuration utilizes an RF-ID element including an IC chip and the antenna, and is configured so that the antenna transmits information stored in the IC chip (see e.g., Japanese unexamined patent publication No. H10-334198).

However, in a case where the recording medium includes a conductive deposition film made of aluminum etc. such as CD-ROMs and DVD-ROMs, inventory management is performed by utilizing an antenna attached to the recording medium, and the conductive deposition film can interfere with the signals that the antenna transmits and receives. Such interference affects a radiating property of the transmitted signal by the antenna, thereby a correct signal cannot be transmitted or received.

SUMMARY OF THE INVENTION

In view of such a conventional art, it is the first objective of the present invention to provide an antenna unit, which has an antenna, capable of maintaining constant communication property of the antenna without being subjected to interference by a conductive member of a body to be detected even when used in a state of being attached to the body such as a CD-ROM or a DVD-ROM including the conductive member.

The second objective of the present invention is to provide a wireless communication structure that has a body, which is to be detected, including a conductive member and an antenna attached to the body and that is configured to transmit a signal via the antenna, the wireless communication structure being capable of maintaining constant communication property of the signal transmitted via the antenna.

The third objective of the present invention is to provide an antenna structure that has an antenna and that is applied to a body, which is to be detected, including a conductive member and a non-conductive member, the antenna structure being capable of maintaining constant communication property of the signal transmitted via the antenna.

The present invention provides, in order to achieve the first objective, an antenna unit including: a non-conductive base film; an endless conductive flat plate member attached onto one surface of the base film and having an opening in a center thereof, and an antenna attached to the one surface of the base film so as to be positioned in the opening of the conductive flat plate member with a gap formed between the antenna and an inner circumferential edge of the conductive flat plate member.

The antenna unit is configured so that the conductive flat plate member interacts (interferes) with the signal transmitted and received via the antenna by surrounding the antenna by the conductive flat plate member, thereby substantially eliminating influence of any possible interaction by another conductive member existing on an exterior of the conductive flat plate member. Consequently, a resonance frequency of transmitting and receiving the signal via the antenna could be uniquely defined without being influenced by an external environment.

Therefore, according to the antenna unit, communication property of the antenna could be maintained constant irrespective of presence of the conductive member on an outer side of the conductive flat plate member. For instance, even when the antenna unit is attached to the body to be detected such as the CD-ROM including the conductive member, interference by the conductive member is less likely to occur.

Preferably, the antenna is a dipole antenna, and the conductive flat plate member includes an annular portion having a circular shape in plane view, and an equilibrium portion arranged substantially symmetrically to the dipole antenna with a center of the annular portion as a reference. The equilibrium portion is either electrically connected with the annular portion, or split into small pieces so as not to affect the resonance frequency transmitted and received through the antenna.

According to the configuration, the equilibrium portion, which is arranged substantially symmetrically to the antenna (dipole antenna) with a center of the annular portion as a reference, acts as a balancer. Therefore, movement balance for the antenna unit as a whole could be evenly maintained when rotated in plane with the center of the annular portion as a rotation axis. Furthermore, since the equilibrium portion and the annular portion of the conductive flat plate member are electrically connected with each other, it is possible to effectively prevent the equilibrium portion from influencing communication properties of the antenna.

More preferably, the antenna may be configured so that the gap between the antenna and the inner circumferential edge of the annular portion is substantially constant across the circumferential direction.

That is, the antenna may be formed in a circular shape along the circumferential direction of the annular portion so that the gap between the antenna and the inner circumferential edge of the annular portion is substantially constant across the circumferential direction, thereby constantly maintaining movement balance of the antenna unit as a whole when rotated in plane with the center of the annular portion as a rotation axis.

The present invention provides, in order to achieve the second objective, a wireless communication structure including: a body, which is to be detected, including a conductive member; an endless conductive flat plate member attached to the body with a non-conductive member being inserted between the conductive flat plate member and the conductive member, the conductive flat plate member having an opening in a center thereof; and an antenna attached to the body so as to be positioned in the opening of the conductive flat plate member with a gap formed between the antenna and an inner circumferential edge of the conductive flat plate member; wherein the conductive flat plate member is attached to the body so that the conductive member is not positioned in the opening in the center when seen in a direction orthogonal to the conductive flat plate member and at least one part of an outer circumferential edge of the conductive member crosses over the conductive flat plate member when seen in that direction.

The wireless communication structure is configured so that the conductive flat plate member interacts (interferes) with the signal transmitted and received via the antenna by surrounding the antenna with the conductive flat plate member, thereby substantially eliminating the influence of possible interaction by another conductive member existing on the exterior of the conductive flat plate member. Consequently, the resonance frequency of transmitting and receiving the signal via the antenna could be uniquely defined without being influenced by the external environment.

Specifically, in the wireless communication structure, the conductive flat plate member is attached to the body so that the conductive member is not positioned in the opening in the center when seen in a direction orthogonal to the conductive flat plate member and at least one part of an outer circumferential edge of the conductive member crosses over the conductive flat plate member when seen in that direction with the non-conductive member being sandwiched between the conductive flat plate member and the conductive member.

According to the configuration, the non-conductive member such as a substrate, protective film, and/or adhesive layer interposed between the conductive flat plate member and the conductive member acts as a dielectric so that electrostatic capacity is generated between the conductive flat plate member and the conductive member, whereby the conductive flat plate member and the conductive member of the body to be detected are assumed to be in an electrically connected state according to presence of the electrostatic capacity.

Therefore, the conductive flat plate member is arranged in a state of being spaced apart by a predetermined gap around the antenna and is practically the only member that may influence (i.e., interact with) transmission/reception waves of the antenna, whereby interference with the transmission/reception waves by the conductive member that may be included in the body to be detected can be reduced.

That is, the wireless communication structure is configured so that the conductive flat plate member and the conductive member are overlapped with the dielectric sandwiched in between in a state where the conductive member is not overlapped with the center opening of the conductive flat plate member when seen along a direction orthogonal to the conductive flat plate member arranged so as to surround the antenna, thereby preventing communication property of the antenna from being influenced due to the presence/absence of the conductive member in the body to be detected and another conductive member so that the communication property of the antenna could be uniquely defined.

The present invention further provides, in order to achieve the second objective, a wireless communication structure including: a disc shaped body that is to be detected and rotates around a rotational axis, the body including an endless conductive member that is arranged coaxially with the rotational axis and has an opening in a center thereof; an endless conductive flat plate member attached to the body with a non-conductive member being inserted between the conductive flat plate member and the conductive member, the conductive flat plate member having an opening in a center thereof; and an antenna attached to the body so as to be positioned in the opening of the conductive flat plate member with a gap formed between the antenna and an inner circumferential edge of the conductive flat plate member; wherein the conductive flat plate member is attached to the body so that the conductive member is not positioned in the opening in the center of the conductive flat plate member when seen along the rotational axis and at least one part of an inner circumferential edge of the conductive member crosses over the conductive flat plate member when seen in the rotational axis.

The wireless communication structure is configured so that the conductive flat plate member interacts (interferes) with the signal transmitted and received via the antenna by surrounding the antenna by the conductive flat plate member, thereby substantially eliminating influence of possible interaction by the another conductive member existing on the exterior of the conductive flat plate member. Consequently, the resonance frequency of transmitting and receiving the signal via the antenna could be uniquely defined without being influenced by the external environment.

Specifically, in the wireless communication structure, the conductive flat plate member is attached to the body to be detected so that the conductive member is not positioned in the opening in the center in a plane view seeing along the rotational axis and at least one part of an inner circumferential edge of the conductive member crosses over the conductive flat plate member in the plane view with the non-conductive member being sandwiched between the conductive flat plate member and the conductive member.

According to the configuration, the non-conductive member such as a substrate, protective film, and/or adhesive layer interposed between the conductive flat plate member and the conductive member acts as a dielectric so that electrostatic capacity is generated between the conductive flat plate member and the conductive member, whereby the conductive flat plate member and the conductive member of the body to be detected are assumed to be in an electrically connected state according to presence of the electrostatic capacity.

Therefore, the conductive flat plate member arranged in a state of being spaced apart by a predetermined gap around the antenna is practically the only member that may influence (i.e., interact) transmission/reception waves of the antenna, whereby interference with the transmission/reception waves by the conductive member that may be included in the body to be detected can be reduced.

That is, the wireless communication structure is configured so that the conductive flat plate member and the conductive member is overlapped with the dielectric sandwiched in between in a state where the conductive member is not overlapped with the center opening of the conductive flat plate member in the plane view seeing along the rotational axis, thereby preventing communication property of the antenna from being influenced due to the presence/absence of the conductive member in the body to be detected and another conductive member so that the communication property of the antenna could be uniquely defined.

In one preferable embodiment, the antenna is a dipole antenna, and the conductive flat plate member includes an annular portion positioned coaxially with the rotational axis and an equilibrium portion arranged substantially symmetrically to the dipole antenna with the rotational axis as a reference, and the equilibrium portion is either electrically connected with the annular portion, or split into small pieces not so as to affect the resonance frequency transmitted and received through the antenna.

Specifically, in the one embodiment, the conductive flat plate member is arranged so that at least one part of the conductive member is overlapped with the conductive flat plate member in the plane view in a state where the conductive member is not overlapped with a surrounding space by the conductive flat plate member in the plane view.

In the arrangement, the equilibrium portion, which is either electrically connected to the annular portion or split into small pieces not so as to affect the resonance frequency transmitted and received through the antenna, is positioned substantially symmetrically to the dipole antenna with the rotational axis as a reference.

Therefore, movement balance of the wireless communication structure as a whole could be evenly maintained when the disc shaped body to be detected rotates, while preventing the communication property of the antenna from being influenced by the external environment.

In another preferable embodiment, the antenna is a dipole antenna, and the conductive flat plate member includes an annular portion positioned coaxially with the rotational axis and a wide width portion extending radially inward from the annular portion at an area other than a region where the antenna is positioned with respect to a circumferential direction with the rotational axis as a reference.

Specifically, in the another embodiment, the conductive flat plate member is arranged so that at least one part of the conductive member is overlapped with the conductive flat plate member in the plane view in a state where the conductive member is not overlapped with a surrounding space by the conductive flat plate member in the plane view.

Further, the conductive flat plate member includes the wide width portion extending radially inward from the annular portion at an area other than a region where the antenna is positioned with respect to a circumferential direction with the rotational axis as a reference.

Therefore, movement balance of the wireless communication structure as a whole could be evenly maintained when the disc shaped body to be detected rotates, while preventing the communication property of the antenna from being influenced by the external environment. Consequently, rotation fluctuation is less likely to occur when rotating the disc shaped body to be detected at high speed to read recorded data, whereby detrimental effect such as reading defect etc., which may be caused by attaching the antenna and the conductive flat plate member, could be suppressed.

More preferably, the inner circumferential edge of the wide width portion has a same diameter as that of the inner circumferential edge of the antenna, and a space is provided between the wide width portion and the antenna with respect to the circumferential direction, the space having a width same as a width of the gap between an outer circumferential edge of the antenna and the inner circumferential edge of the annular portion.

In still another preferable embodiment, the antenna is a dipole antenna, and the conductive flat plate member includes an annular portion positioned coaxially with the rotational axis and a wide width portion extending radially inward from the annular portion at an area substantially symmetric to the dipole antenna with the rotational axis as a reference.

Specifically, in the still another embodiment,. the conductive flat plate member is arranged so that at least one part of the conductive member is overlapped with the conductive flat plate member in the plane view in a state where the conductive member is not overlapped with a surrounding space by the conductive flat plate member in the plane view.

Further, the conductive flat plate member includes the wide width portion extending radially inward from the annular portion at an area substantially symmetric to the dipole antenna with the rotational axis as a reference.

Therefore, movement balance of the wireless communication structure as a whole could be evenly maintained when the disc shaped body to be detected rotates, while preventing the communication property of the antenna from being influenced by the external environment. Consequently, rotation fluctuation is less likely to occur when rotating the disc shaped body to be detected at high speed to read recorded data, whereby detrimental effect such as reading defect etc., which may be caused by attaching the antenna and the conductive flat plate member, could be suppressed.

More preferably, the inner circumferential edge of the wide width portion has a same diameter as that of the inner circumferential edge of the antenna, and the wide width portion has a substantially same circumferential length as that of the antenna.

In the above various embodiments, the conductive flat plate member may be preferably attached to the body to be detected so as to cross over the inner circumferential edge of the conductive member across an entire circumferential region when seen along the rotational axis.

According to the configuration, it is possible to increase a region where the conductive flat plate member and the conductive member are electrically connected with each other (i.e., electrostatic capacity between conductive flat plate member and conductive member), thereby more effectively reducing influence of interaction by the conductive member in the body to be detected and the another external conductive member.

The resonance frequency of the antenna and the resonance frequency of the conductive flat plate member are preferably made different from each other. In this case, two resonance frequencies are provided, and thus a band for the antenna can be extended.

The present invention also provides, in order to achieve the third objective, an antenna structure applied to a body, which is to be detected, including a flat-plate shaped conductive member and a non-conductive member for covering at least the first surface on one side of the conductive member, the antenna structure including: an endless conductive flat plate member attached to the first surface on a side opposite to the conductive member of the non-conductive member; and the antenna attached to the first surface of the non-conducive member so as to be positioned in the opening in the center of the conductive flat plate member while forming a gap between the antenna and the inner circumferential edge of the conductive flat plate member; wherein the annular conductive flat plate member is arranged so that at least one part thereof overlaps the conductive member without the conductive member being positioned in the opening in the center when seen in a direction orthogonal to the conductive flat plate member.

According to the antenna structure, only the conductive flat plate member influences the communication property of the antenna in fact, thereby substantially eliminating the influence on the communication property of the antenna by the conductive member of the body to be detected and another conductive member existing outsides. Consequently, it is possible to prevent the communication property of the antenna from being fluctuated depending on the external environment.

Preferably, the conductive flat plate member and the antenna may be laminated on a non-conductive base file so as to form an antenna unit, and the conductive flat plate member and the antenna are attached to the first surface of the non-conductive member via the base film.

According to the configuration, it is possible to enhance workability in attaching the conductive flat plate member and the antenna to the body to be detected.

For example, the body to be detected may be a flat-plate shaped rotational recording medium that rotates around a rotational axis orthogonal to the conductive member, the conductive member may have an endless shape coaxially with the rotational axis, and the conductive flat plate member may be arranged so that an inner circumferential edge of the conductive member is positioned between an inner circumferential edge and an outer circumferential edge of the conductive flat plate member with respect to a radial direction position with the rotational axis as a reference.

Preferably, an overlapping area of the conductive flat plate member and the conductive member when seen along the rotational axis has a constant width with respect to a radial direction with the rotational axis as a reference over the entire circumferential region around the rotational axis.

Preferably, the gap between the antenna and the inner circumferential edge of the conductive flat plate member has a constant width around the rotational axis.

BRIEF DESCRIPTION OF THE DRAWINGS

The above, and other objectives, features and advantages of the present invention will become apparent from the detailed description thereof in conjunction with the accompanying drawings wherein.

DETAILED DESCRIPTION OF THE PREFERRED EMBODIMENTS

A wireless communication structure equipped with an antenna unit according to one embodiment of the present invention will now be described with reference to the accompanying drawings.

Figure 1:
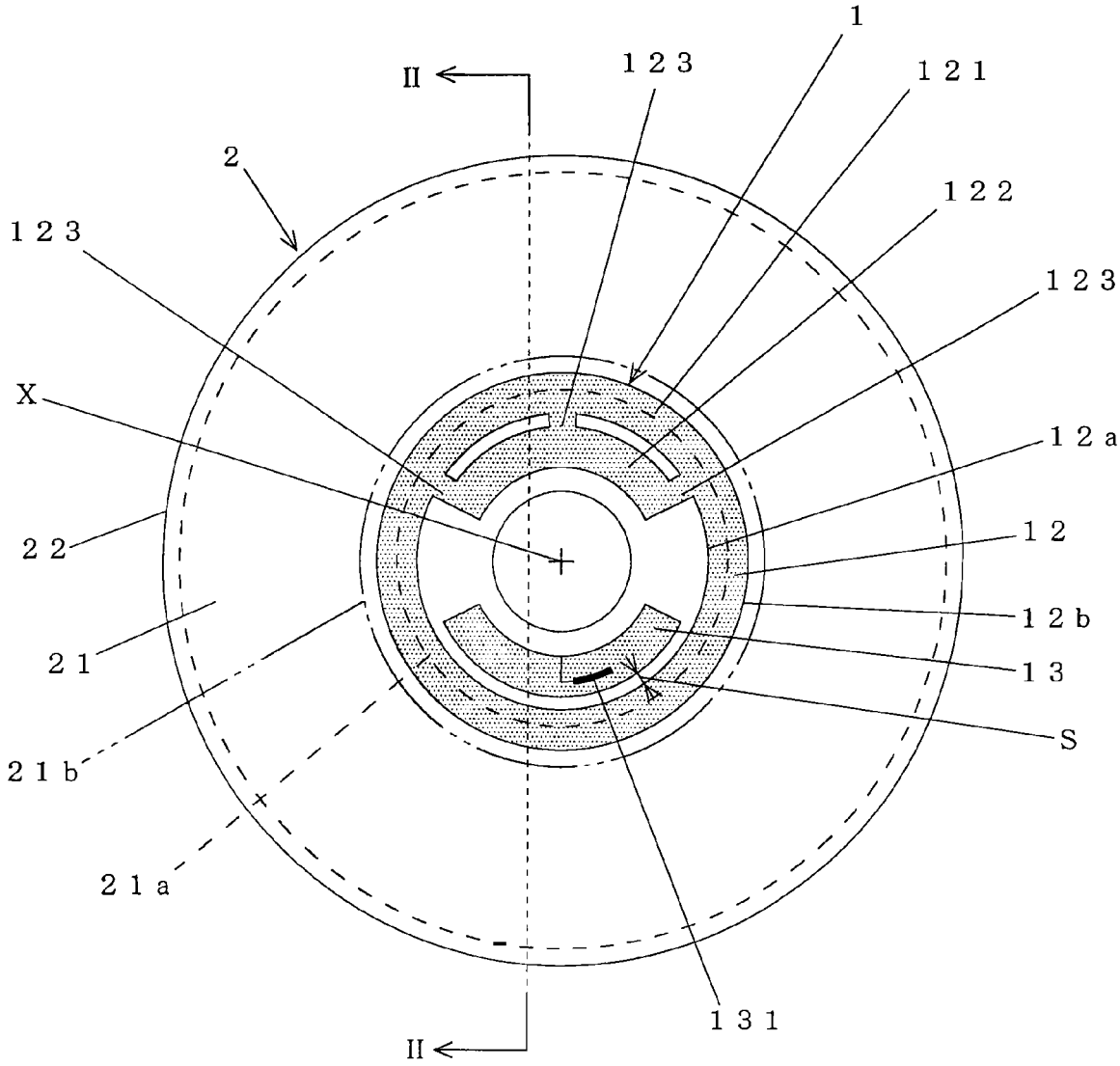
FIG. 1 is a schematic plan view of a wireless communication structure equipped with an antenna unit according to the first embodiment of the present invention.
Figure 2:
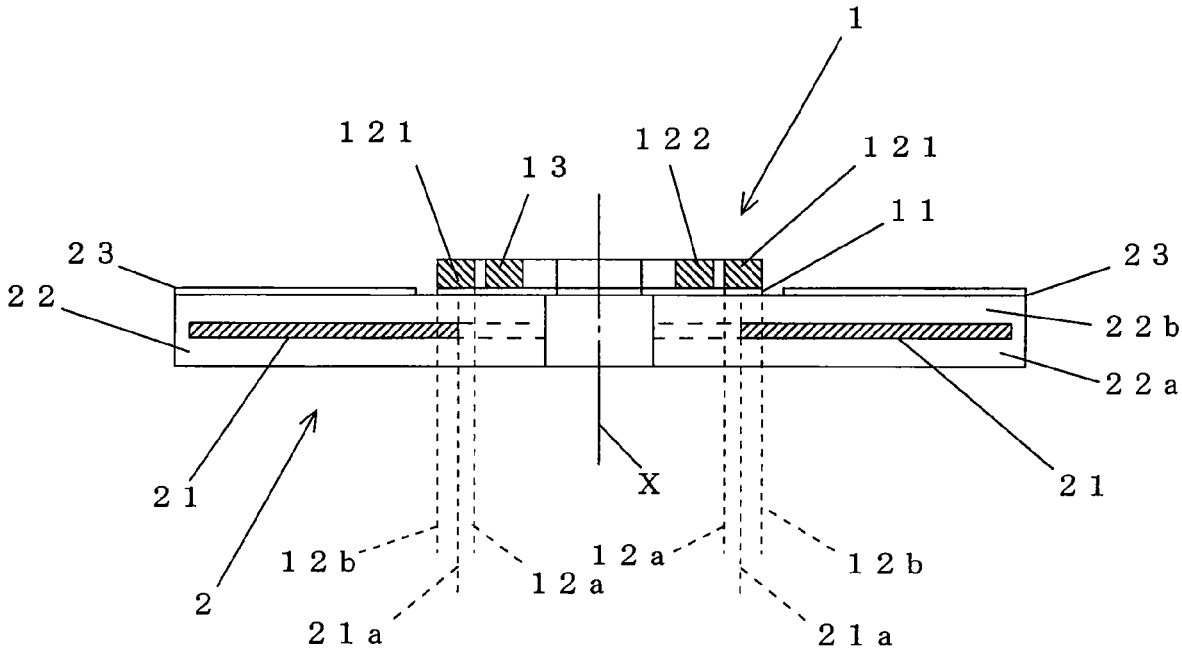
FIG. 2 is a cross sectional view taken along line II-II in FIG. 1.

FIG. 1 is a schematic plan view of the wireless communication structure equipped with the antenna unit according to the present embodiment. FIG. 2 is a cross sectional view taken along line II-II in FIG. 1.

As shown in FIGS. 1 and 2, an antenna unit 1 according to the present embodiment includes a non-conductive base film 11; an endless conductive flat plate member 12 attached onto the first surface of the base film 11 and having an opening in a center thereof; and an antenna 13 attached to the first surface of the base film 11 so as to be positioned in the opening (inside an inner circumferential edge thereof) of the conductive flat plate member 12 with a gap S formed between the antenna 13 and the inner circumferential edge 12*a* of the conductive flat plate member 12.

Preferably, the antenna unit 1 may further include a protective film (not shown) for covering the first surface, which is opposite the second surface facing the base film 11, of the antenna 13. The protective film may have a shape same as that of the base film 11, that is, a shape capable of covering the antenna 13 and the conductive flat plate member 12.

The first surface refers to a surface facing one side in a direction orthogonal to a plane where the flat plate member 12 is positioned, and the second surface to be described below refers to a surface facing the opposite side to the first surface.

In other words, the endless conductive flat plate member 12 having the opening in the center thereof and the antenna 13 are attached to the first surface of the non-conductive base film 11 in the antenna unit 1. The antenna 13 is attached to the base film 11 so as to be positioned within the opening of the conductive flat plate member 12 with the gap S formed between the antenna 13 and the inner circumferential edge 12*a* of the conductive flat plate member 12.

In the present embodiment, the antenna unit 1 is attached to a disc shaped body to be detected 2.

Specifically, the body to be detected 2 includes an aluminum deposition layer 21, which is the conductive member arranged substantially coaxial with a rotation axis X, the aluminum deposition layer 21 being in an endless form with the opening in the center thereof.

The antenna unit 1 is configured so that the second surface of the base film 11 is attached to the first surface of the body 2 in such a manner that at least one part of the conductive flat plate member 12 crosses over the inner circumferential edge 21*a* of the aluminum deposition layer 21 in plan view along the rotation axis X.

That is, the antenna unit 1 is attached to the body to be detected 2 so that at least one part of the aluminum deposition layer 21 overlaps the conductive flat plate member 12 in plan view while the aluminum deposition layer 21 not overlapping the opening in the center of the conductive flat plate member 21 in plan view.

For example, the antenna unit 1 is formed by laminating a conductive film made of aluminum etc. on the base film 11 made of various resin sheets having insulation property, and etching the conductive film to a predetermined form to obtain the conductive flat plate member 12 and the antenna 13.

Predetermined information (information regarding body to be detected 2 such as a data folder name, identification number, recorded date etc.) is recorded on the antenna 13. Furthermore, the IC chip 131 capable of transmitting and receiving the information is attached to the antenna 13.

The antenna 13 may be configured to constantly transmit and receive the information, or may be configured to transmit and receive the information at each time when receiving a signal requesting for information.

The disc shaped body to be detected 2 is a disc recording medium such as a CD-ROM or a DVD-ROM.

For example, the disc recording medium includes a polycarbonate resin layer 22*a*, a conductive member 21 laminated by depositing aluminum or the like on one part of the resin layer 22*a*, and a protection polycarbonate resin layer 22*b* laminated so as to cover the conductive member 21, with the conductive member 21 being sandwiched between the resin layers 22*a*, 22*b*.

The disc shaped body to be detected 2 generally has one of the first surface and the second surface of the conductive member 21 as a data reading surface and the other surface as a label surface formed (printed or attached with a sheet) with a label 23.

In the present embodiment, the antenna unit 1 is attached to a label surface side.

The base film 11 may be adhered to the body to be detected 2 with adhesive, or the base film 11 itself may be an adhesive layer having viscosity so that the base film 11 may be directly adhered to the body to be detected 2.

In the wireless communication structure, the antenna 13 is attached to the body to be detected 2 so as to be positioned in the opening of the conductive flat plate member 12 with the gap S formed between the antenna 13 and the inner circumferential edge 12*a* of the conductive flat plate member 12. That is, the antenna 13 is arranged in a state of surrounded by the conductive flat plate member 12 without contacting thereto in plan view.

Furthermore, in the present embodiment, the conductive flat plate member 12 is attached to the body to be detected 2 so as to cross over the inner circumferential edge 21*a* of the conductive member 21 in the body 2 across an entire periphery about the rotation axis X in plan view. That is, the antenna unit 1 is attached to the body 2 so that the inner circumferential edge 21*a* of the conductive member 21 in the body 2 is positioned between the inner circumferential edge 12*a* and the outer circumferential edge 12*b* of the conductive flat plate member 12 in plan view (see FIG. 1).

In the antenna unit 1, the antenna 13 is surrounded by the conductive flat plate member 12 so that the conductive flat plate member 12 interacts (interferes) with the signal transmitted and received by the antenna 13. In other words, since the antenna 13 is surrounded by the conductive flat plate member 12 that interacts with the signal transmitted and received by the antenna 13, influence of interaction by the conductive member 21 and another conductive member existing on the exterior of the conductive flat plate member 12 is substantially eliminated, whereby a resonance frequency of transmitting and receiving the signal by the antenna 13 is uniquely defined by solid state properties of the antenna 13 and the conductive flat plate member 12.

Moreover, in the antenna unit 1, the conductive member 21 in the body to be detected 2 does not overlap the opening in the center of the conductive flat plate member 12 in plan view, and the conductive flat plate member 12 is arranged so as to cross over the inner circumferential edge 21*a* of the conductive member 21 in plan view with the base film 11 and the resin layer 22 sandwiched between the conductive flat plate member 12 and the conductive member 21. Therefore, a portion overlapped in plan view (region surrounded by the inner circumferential edge 21*a* of the conductive member 21 in the body 2 and the outer circumferential edge 12*b* of the conductive flat plate member 12 in plane view) serves as a capacitor having the insulative base film 11 and the resin member 22 of the body 2 as dielectrics.

Electrostatic capacity thereby is generated between the conductive flat plate member 12 and the conductive member 21 in the body to be detected 2, and thereby the conductive flat plate member 12 and the conductive member 21 are assumed to be electrically connected with each other.

Therefore, only the conductive flat plate member 12, which is arranged around the antenna 13 with being spaced apart from the antenna 13 by a predetermined gap S, substantially influences (interacts) with transmission/reception waves by the antenna 13, thereby effectively preventing the conductive member 21 in the body to be detected 2 and the another conductive member from interacting (interfering) with the transmission/reception waves.

Communication properties of the antenna 13 are thus effectively prevented from being influenced or interfered with by the conducive member 21 in the body to be detected 2, and it is possible to uniquely define the communication property of the antenna 13 by surrounding the antenna 13 formed in a plane shape with the endless conductive flat plate member 12 and overlapping the conductive flat plate member 12 and the conductive member 21 in plan view with the dielectrics sandwiched in between while the conductive member 21 in the body to be detected 2 is not positioned in the opening in the center of the conductive flat plate member 12 in plan view.

Moreover, in the present embodiment, since the conductive flat plate member 12 is attached so as to cross over the entire periphery of the inner circumferential edge 21*a* of the conductive member 21 in the body to be detected 2 in plan view, and thus the overlapped region of the conductive flat plate member 12 with the conductive member 21 in plan view can be increased. According to such a configuration, an electrically connected region (electrostatic capacity) could be increased, and the conductive flat plate member 12 and the conductive member 21 are electrically merged, thereby more effectively reducing influence of interaction by the conductive member 21.

The larger the electrostatic capacity between the conductive flat plate member 12 and the conductive member 21, the smaller the influence of interaction by the conductive member 21, thus the overlapped region in plan view of the conductive flat plate member 12 with the conductive member 21 is preferably made as large as possible in a radial direction. According to such a configuration, it is possible to increase an area (area of the overlapped region) where the conductive flat plate member 12 faces the conductive member 21, and the electrostatic capacity increases in proportion to the area.

However, if the conductive flat plate member 12 reaches a data recording region in the conductive member 21 in plan view, a function as a recording medium of the body to be detected 2 may be deteriorated. Therefore, the outer circumferential edge 12*b* of the conductive flat plate member 12 is preferably positioned on the inner side of the inner circumferential edge 21*b* of the data region of the conductive member 21 in the body to be detected 2.

The electrostatic capacity is inversely proportional to a distance between the conductive flat plate member 12 and the conductive member 21, and thus the distance (i.e., thickness of the dielectric formed by the base film 11 and the resin member 22 of the body to be detected 2) is preferably set as small as possible.

The resonance frequency of the antenna 13 and the resonance frequency of the conductive flat plate member 12 are preferably made different from each other. According to such a configuration, the two resonance frequencies are provided, and thus a band for the antenna can be extended in the antenna unit 1 as a whole. The resonance frequencies of the antenna 13 and the conductive flat plate member 12 could be appropriately defined by changing length, width, thickness, and the like of the antenna 13 and/or the conductive flat plate member 12.

In the present embodiment, the antenna 13 is formed in a dipole antenna.

The conductive flat plate member 12 includes an annular portion 121 arranged substantially coaxial with the rotation axis X of the body to be detected 2, and an equilibrium portion 122 arranged substantially symmetric to the dipole antenna 13 with a center (center of gravity) X of the body to be detected 2 as a reference, with the annular portion 121 and the equilibrium portion 122 being electrically connected with each other by way of a connecting portion 123. The annular portion 121, the equilibrium portion 122, and the connecting portion 123 are formed by etching a conductive film made of aluminum etc. as described above.

In this case, the annular portion 122 of the conductive flat plate member 12 is arranged so as to cross over the inner circumferential edge 21 a of the conductive member 21 in the body to be detected 2 in plane view. Furthermore, the equilibrium portion 122 is arranged at a position substantially symmetric to the antenna (dipole antenna) 13 with the center X of the body to be detected 2 as a reference. The annular portion 121 and the equilibrium portion 122 are electrically connected with each other by way of the connecting portion 123.

Movement balance in rotating the disc shaped body to be detected 2 is evenly maintained in the wireless communication structure as a whole by arranging the annular portion 121 of the conductive flat plate member 12 substantially coaxial with the rotation axis X of the body to be detected 2 and arranging the antenna 13 and the equilibrium portion 122 substantially symmetric to each other with the rotation axis X of the body to be detected 2 as a reference.

Furthermore, the equilibrium portion 122 is electrically connected to the annular portion 121 by way of the connecting portion 123. Therefore, it is possible to prevent the equilibrium portion 122 from influencing communication property of the antenna 13.

Both ends and a central part of the equilibrium portion 122 are electrically connected to the annular portion 121 by way of the connecting portion 123 in the present embodiment, while the present invention is not limited to such a configuration.

The equilibrium portion 122 may be split into small pieces not so as to affect the resonance frequency transmitted and received through the antenna 13, instead of being electrically connected to the annular portion 121.

In the modified configuration, it is also possible to evenly maintain movement balance in rotating the disc shaped body to be detected 2 in the wireless communication structure as a whole while preventing the equilibrium portion 122 from influencing communication property of the antenna 13.

In the present embodiment, the antenna 13 is configured so that the gap S between the antenna 13 and the inner circumferential edge 12*a* of the annular portion 121 is substantially constant across a circumferential direction.

In other words, in the present embodiment, the antenna 13 is formed in a circular arc shape along the circumferential direction of the annular portion 121 so that the gap S between the antenna 13 and the inner circumferential edge 12*a* of the annular portion 121 of the conductive flat plate member 12 is substantially constant in the circumferential direction. According to such a configuration, movement balance of the antenna unit 1 as a whole (i.e., entire wireless communication structure) in rotating the body to be detected 2 in plane with the center (i.e., center X of body to be detected 2) of the annular portion 121 as the rotation axis could be more evenly maintained.

Other embodiments of the antenna unit (wireless communication structure) according to the present invention will now be described. FIGS. 3 to 6 are plan views showing other embodiments of the antenna unit according to the present invention. Same reference characters are denoted for configurations similar to those of the first embodiment, and the description thereof will not be repeated. The antenna units 3 to 6 of FIGS. 3 to 5 may configure the wireless communication structure by being attached to the disc shaped body to be detected 2 such as a CD-ROM as in the first embodiment, but illustration of the body 2 will not be provided.

Figure 3:
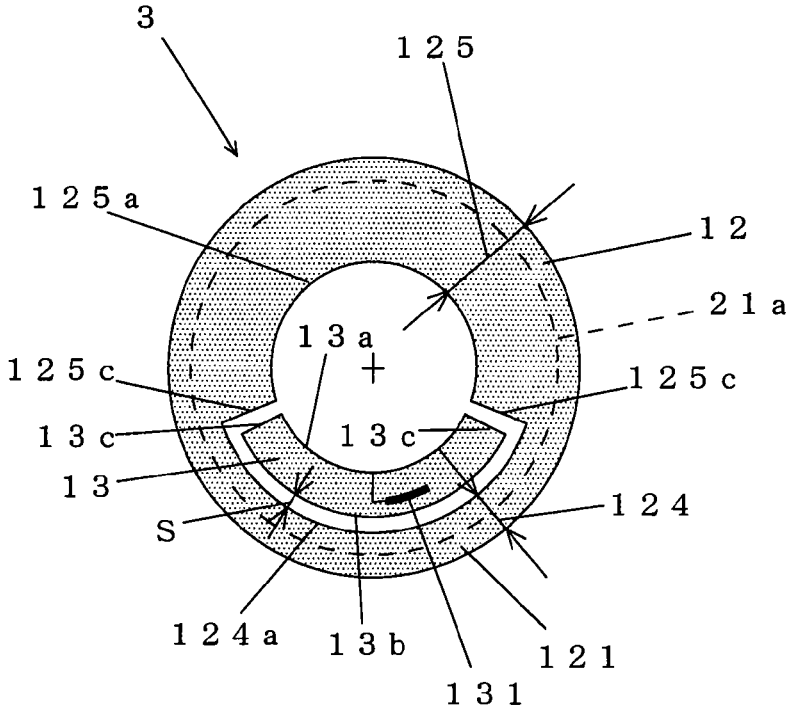
FIG. 3 is a schematic plan view of an antenna unit according to another embodiment of the present invention.
Figure 3:
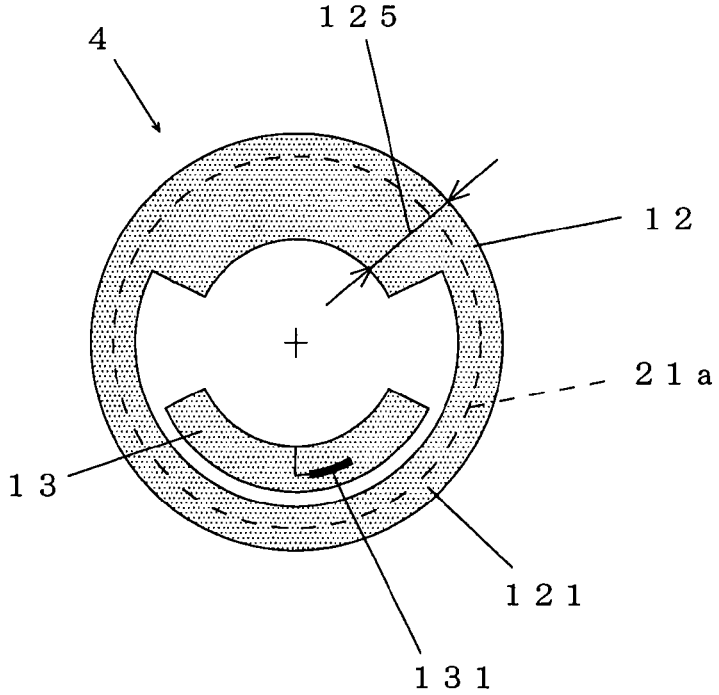

In the antenna unit 3 shown in FIG. 3(*a*), the conductive flat plate member 12 has an annular shape that is substantially coaxial with the body to be detected 2 in plan view, and has one part in vicinity of the dipole antenna 13 formed into a narrow width (narrow width portion 124). The antenna 13 is formed in a dipole antenna.

Specifically, in the embodiment shown in FIG. 3(*a*), the conductive flat plate member 12 has the annular portion 121 arranged substantially coaxial with the rotation axis X of the body to be detected 2. The annular portion 121 is arranged so as to cross over the inner circumferential edge 21*a* of the conductive member 21 in the body to be detected 2 in plan view with the dielectrics sandwiched in between. Furthermore, the conductive flat plate member 12 includes a wide width portion 125 extending radially inward from the annular portion 121 at an area other than a region where the antenna (dipole antenna) 13 is positioned with respect to a circumferential direction with the rotation axis X as a reference.

That is, in the antenna unit 3 shown in FIG. 3(*a*), the antenna 13 is arranged in a space defined by the narrow width portion 124 with the gap S formed between the outer circumferential edge 13*b* of the antenna 13 and the inner circumferential edge 124*a* of the narrow width portion 124 in the conductive flat plate member 12.

According to such a configuration, movement balance in rotating the disc shaped body to be detected 2 is evenly maintained in the antenna unit 3 as a whole. Therefore, rotation fluctuation is less likely to occur when rotating the disc shaped body to be detected 2 at high speed to read recorded data etc., whereby detrimental effect such as reading defect etc., which may be caused by attaching the antenna unit 3, is suppressed.

A terminating end 125*c* in the circumferential direction of the wide width portion 125 in the conductive flat plate member 12, and a terminating end 13*c* in the circumferential direction of the antenna 13 facing the terminating end 125*c* in the circumferential direction are preferably brought as close as possible while forming a gap same as or greater than the gap S.

According to such a configuration, weight balance about the rotation axis of the entire antenna unit 3 is further enhanced without degrading communication property of the antenna 13.

Furthermore, the inner circumferential edge 125*a* of the wide width portion 125 in the conductive flat plate member 12 has the same diameter as the inner circumferential edge 13*a* of the antenna 13.

According to such a configuration, weight balance about the rotation axis of the entire antenna unit 3 is further enhanced.

In the antenna unit 4 shown in FIG. 3(*b*), the conductive flat plate member 12 has an annular shape that is substantially coaxial with the rotation axis X of the body to be detected 2 in plane view, and has one part (wide width portion 125) that is formed into a wide width near a position substantially symmetric to the dipole antenna 13 with the rotation axis X of the body to be detected 2 as a reference. The antenna 13 is formed in a dipole antenna.

Specifically, in the embodiment shown in FIG. 3(*b*), the conductive flat plate member 12 has an annular portion 121 arranged substantially coaxially with the rotation axis X of the body to be detected 2. The annular portion 121 is arranged so as to cross over the inner circumferential edge 21*a* of the conductive member 21 in the body to be detected 2 in plan view with the dielectrics sandwiched in between. Furthermore, the conductive flat plate member 12 includes the wide width portion 125 extending radially inward from the annular portion 121 at an area substantially symmetric to the dipole antenna 13 with the rotation axis X of the body to be detected 2 as a reference.

In the antenna unit 4 as well, movement balance in rotating the disc shaped body to be detected 2 is evenly maintained in the antenna unit 4 as a whole. Therefore, rotation fluctuation is less likely to occur when rotating the disc shaped body to be detected 2 even at high speed to read recorded data etc., whereby detrimental effect such as reading defect etc., which may be caused by attaching the antenna unit 4, is suppressed.

Figure 4:
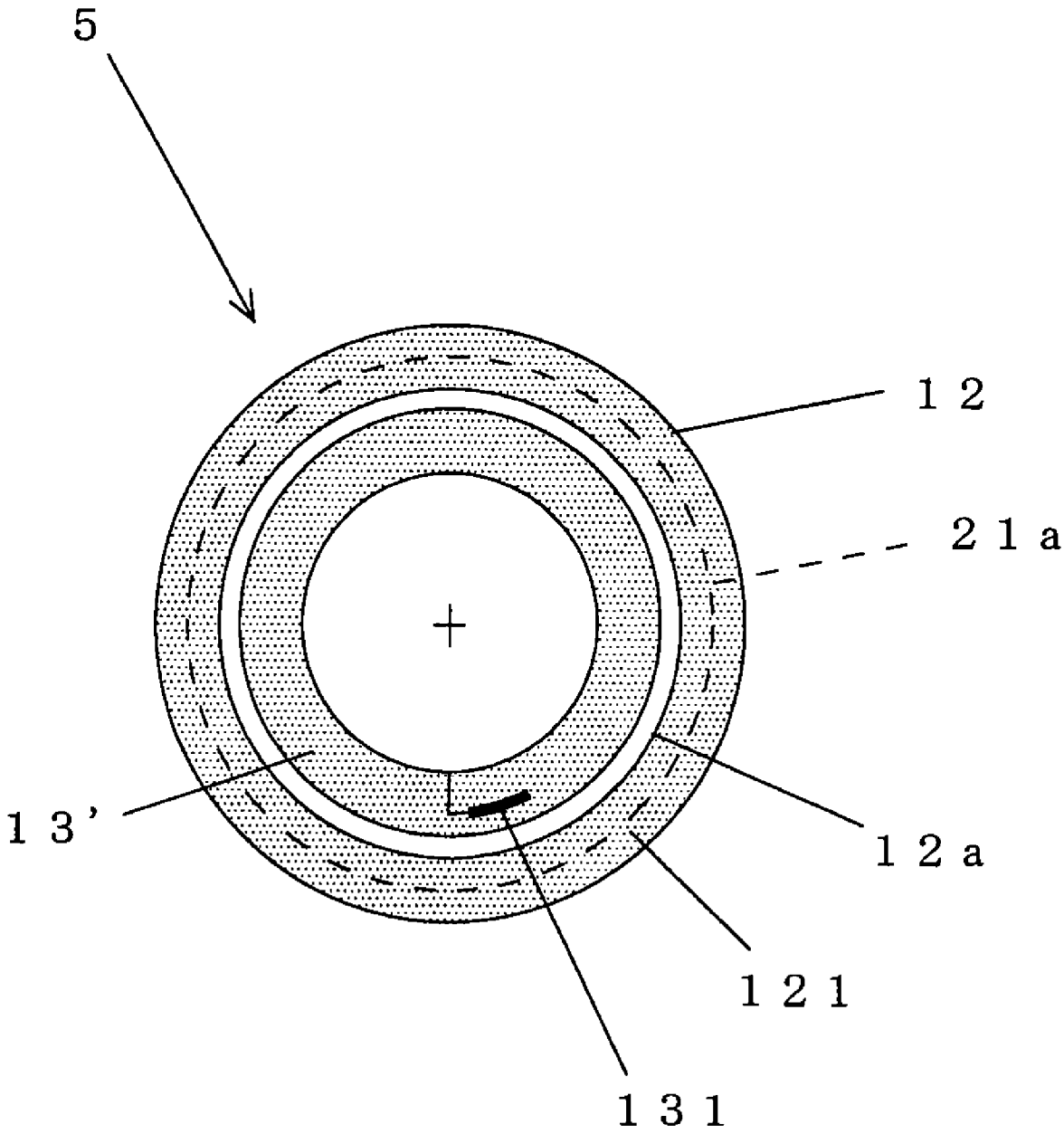
FIG. 4 is a schematic plan view of an antenna unit according to still another embodiment of the present invention.

In the antenna unit 5 shown in FIG. 4, the conductive flat plate member 12 has an annular shape that is substantially coaxial with the rotation axis X of the body to be detected 2, and an antenna 13' is an endless loop antenna having an opening in a center thereof and arranged coaxially in the opening of the conductive flat plate member 12.

Specifically, in the embodiment shown in FIG. 4, the conductive flat plate member 12 has an annular portion 121 arranged substantially coaxially with the rotation axis X of the body to be detected 2. The annular portion 121 is arranged so as to cross over the inner circumferential edge 21*a* of the conductive member 21 in plan view with dielectric sandwiched in between.

The antenna 13' is formed in an annular loop antenna arranged coaxially with the annular portion 121 in the opening in the center of the annular portion 121.

That is, in the embodiment shown in FIG. 4, the antenna 13' is arranged in the opening in the center of the annular portion 121 of the conductive flat plate member 12 that is arranged coaxially with the rotation axis X of the body to be detected 2 so as to cross over the inner circumferential edge 21*a* of the conductive member 21 in plane view with a gap S formed between the antenna 13' and the inner circumferential edge 12*a* of the conductive flat plate member 12 across an entire region in the circumferential direction.

In the thus configured antenna unit 5 as well, movement balance in rotating the disc shaped body to be detected 2 is evenly maintained in the antenna unit 5 as a whole. Therefore, rotation fluctuation is less likely to occur when rotating the disc shaped body to be detected 2 even at high speed to read recorded data etc., whereby detrimental effect such as reading defect etc., which may be caused by attaching the antenna unit 5, is suppressed.

In each of the above embodiments, the conductive flat plate member 12 is attached so as to cross over the inner circumferential edge 21*a* of the conductive member 21 in the body to be detected 2 across the entire periphery in plan view. However, the conductive flat plate member 12 is not limited thereto, and may be attached so as to cross over at least one part of the inner circumferential edge 21*a*.

Figure 5:
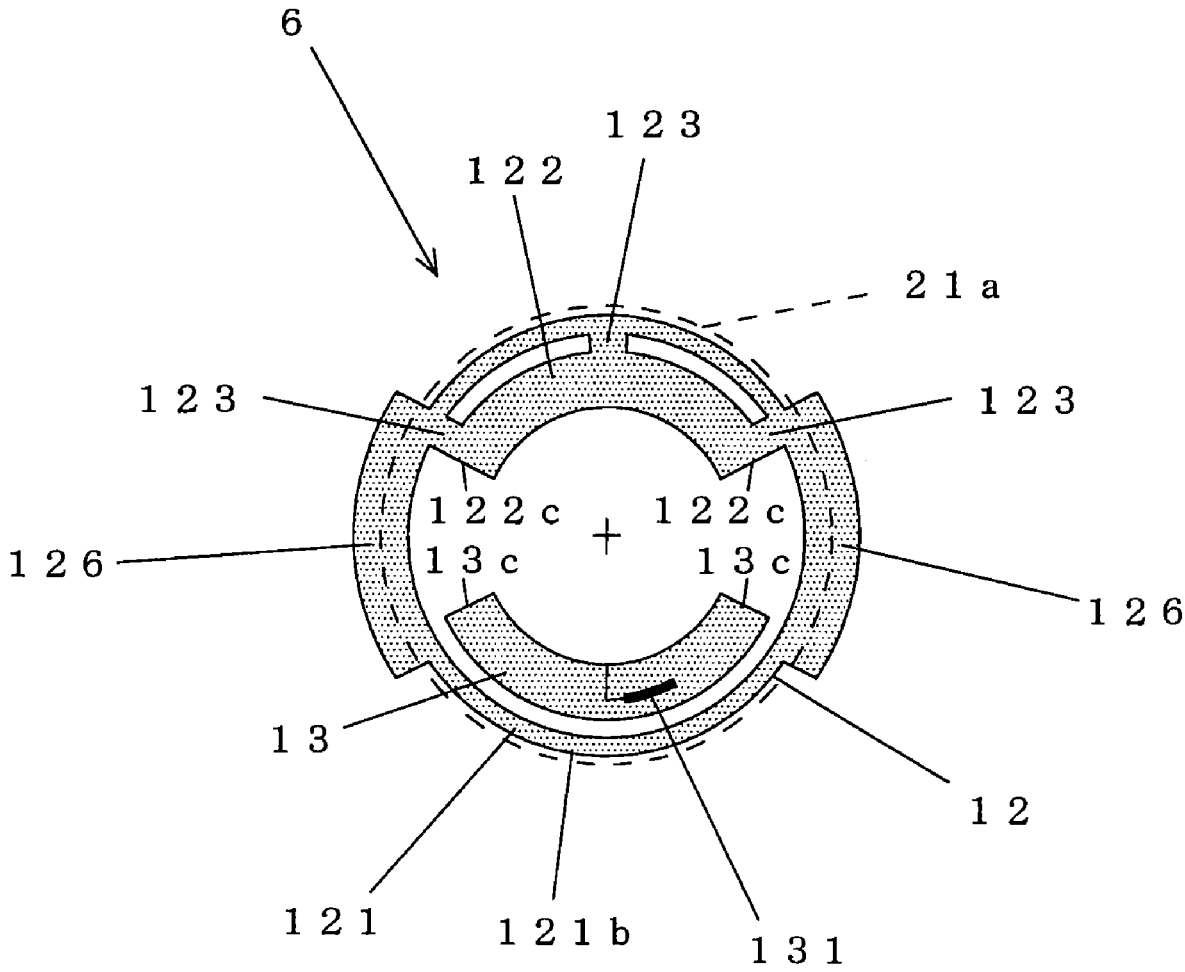
FIG. 5 is a schematic plan view of an antenna unit according to still another embodiment of the present invention.

For instance, as in the antenna unit 6 shown in FIG. 5, the conductive flat plate member 12 could be provided with an ear portion 126 extending outward from the annular portion 121 at an area that extends to the both sides of the circumferential direction with the rotation axis X as the reference from a center position on an imaginary line substantially orthogonal to an imaginary line passing centers with respect to the circumferential direction of the equilibrium portion 122 and the antenna 13, and the conductive flat plate member 12 is attached so that the ear portion 126 crosses over the inner circumferential edge 21*a* of the conductive member 21 in the body to be detected 2 in plan view.

That is, in the antenna unit 6 shown in FIG. 5, the conductive flat plate member 12 includes the annular portion 121 having the outer circumferential edge 121*b* positioned radially inward of the inner circumferential edge 21*a* of the conductive member 21 with the rotation axis X of the body to be detected 2 as a reference, the equilibrium portion 122 extending radially inward from the annular portion 121 by way of the connecting portion 123 so as to be arranged substantially symmetric to the dipole antenna 13 with the rotation axis X as a reference, and the ear portion 126 extending radially outward from the annular portion 121 so as to cross over the inner circumferential edge 21*a* of the conductive member 21 in plan view with dielectrics sandwiched in between.

In the embodiment shown in FIG. 5, the conductive flat plate member 12 includes a pair of the ear portions 126. In the embodiment, the pair of ear portions 126 are preferably positioned between the antenna 13 and the equilibrium portion 122 with respect to a position in the circumferential direction with the rotation axis X as a reference, and are arranged symmetric to each other with the rotation axis X as a reference.

That is, the pair of ear portions 126 extend along the circumferential direction between an end 13*c* in the circumferential direction of the antenna 13 and an end 122*c* in the circumferential direction of the equilibrium portion 122 so as to have substantially the same length as an interval in the circumferential direction between the end 13*c* in the circumferential direction of the antenna 13 and the end 122*c* in the circumferential direction of the equilibrium portion 122.

According to such embodiment as well, movement balance in rotating the disc shaped body to be detected 2 is evenly maintained in the antenna unit 6 as a whole. Therefore, rotation fluctuation is less likely to occur when rotating the disc shaped body to be detected 2 even at high speed to read recorded data etc., whereby detrimental effect such as reading defect etc., which may be caused by attaching the antenna unit 6, is suppressed.

Figure 6:
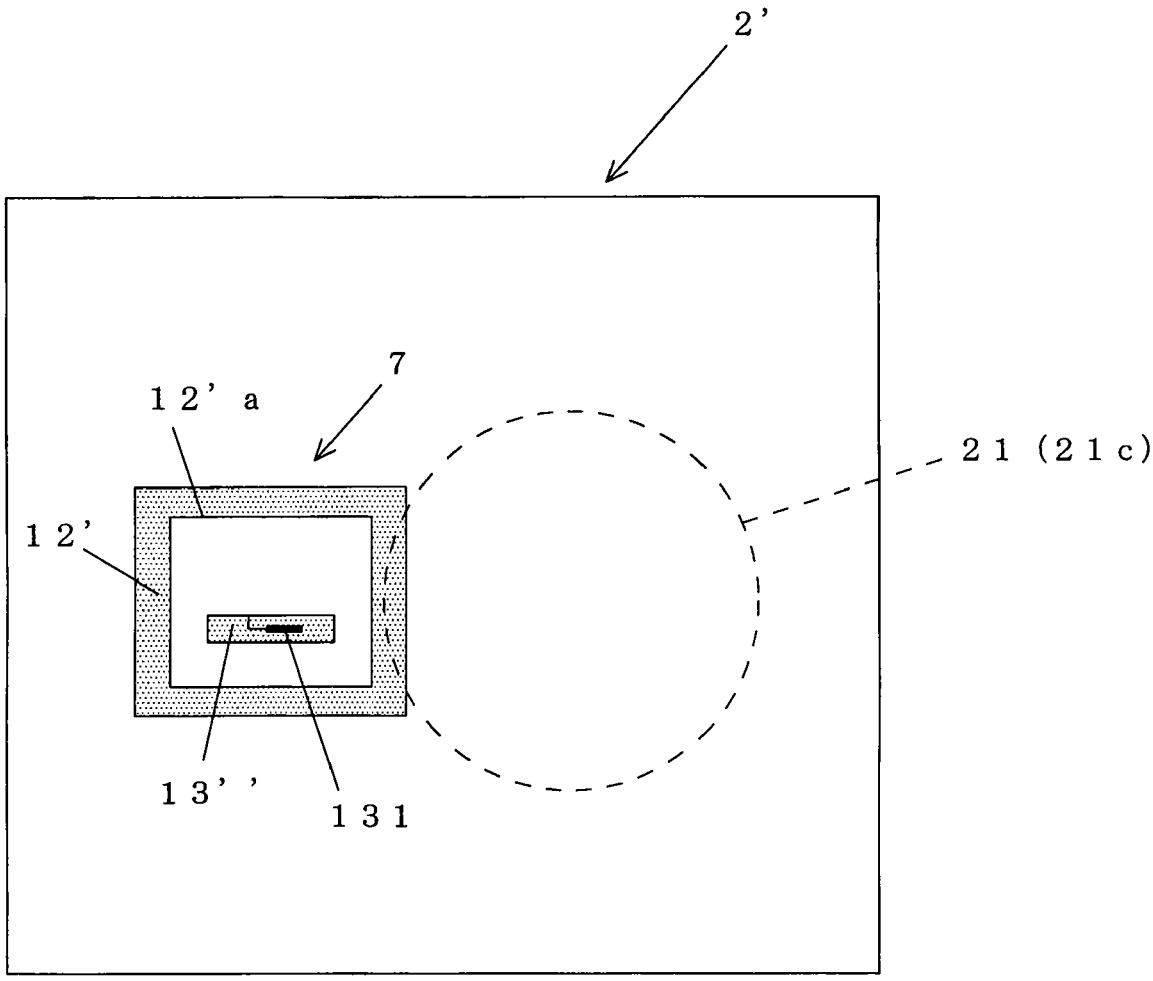
FIG. 6 is a schematic plan view of an antenna unit according to still another embodiment of the present invention.

Furthermore, the antenna unit according to the present invention is not limited to those attached to the disc shaped body to be detected 2, and may be attached to a square-plate shaped body to be detected 2'. For instance, an antenna unit 7 shown in FIG. 6 is attached to the body to be detected 2' having a rectangular shape in plan view including the conductive member 21.

Specifically, the antenna unit 7 includes an endless conductive flat plate member 12' having an opening in a center thereof, and an antenna 13" arranged in the opening of the conductive flat plate member 12' while forming a gap between the antenna 13' and the inner circumferential edge 12'*a* of the conductive flat plate member 12', where the antenna unit 7 is attached to the body to be detected 2' so that at least one part of the conductive flat plate member 12' crosses over the outer circumferential edge 21*c* of the conductive member 21 with dielectrics sandwiched in between in plan view.

That is, a wireless communication structure including the antenna unit 7 is configured so that one part of the outer circumferential edge 21*c* of the conductive member 21 in the body to be detected 2' overlaps an annular portion of the conductive flat plate member 12' in plan view, and the conductive member 21 is not positioned in the opening in the center of the conductive flat plate member 12' in plan view.

According to such a configuration as well, the annular portion of the conductive flat plate member 12' overlaps the conductive member 21 of the body to be detected 2' in plan view with the dielectrics sandwiched in between, whereby communication property of the antenna 13" can be effectively prevented from changing due to an external environment, and the communication property of the antenna 13" can be uniquely determined.

While the embodiments according to the present invention have been described above, the present invention is not limited to such embodiments, and various modifications, changes, and corrections may be made within the scope not departing from a purpose of the invention.

Figure 7:
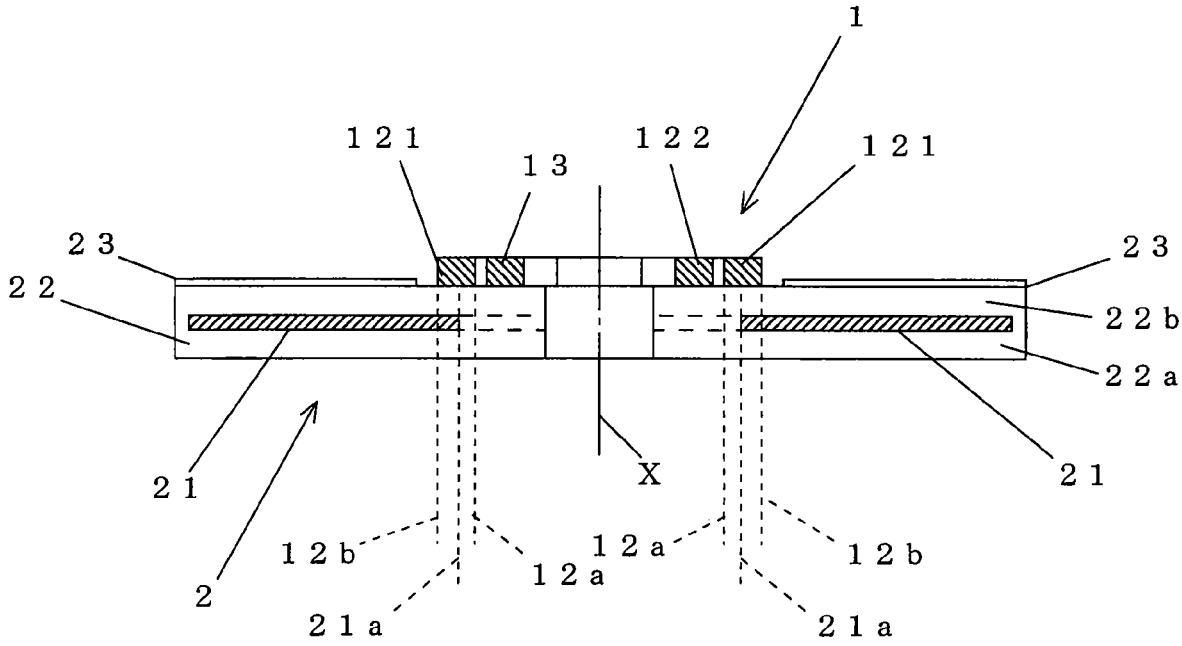
FIG. 7 is a vertical sectional view on a wireless communication structure according to still another embodiment of the present invention.

For instance, as shown in FIG. 7, the antenna 13 and the conductive flat plate member 12 may be directly attached to the body 2, which is to be detected, including the conductive member 21 and a non-conductive member 22*b* that covers at least the first surface on one side of the conductive member.

That is, the wireless communication structure shown in FIG. 7 includes the body 2, which is to be detected, including the flat-plate shaped conductive member 21 and the non-conductive member 22*b* for covering at least the first surface on one side of the conductive member 21, the endless conductive flat plate member 12 attached to the first surface on a side opposite to the conductive member 21 of the non-conductive member 22*b*, and the antenna 13 is attached to the first surface of the non-conducive member 22*b* so as to be positioned in the opening in the center of the conductive flat plate member 12 while forming a gap S between the antenna 13 and the inner circumferential edge 12*a* of the conductive flat plate member 12.

The annular conductive flat plate member 12 is arranged so that at least one part thereof overlaps the conductive member 21 without the conductive member 21 being positioned in the opening in the center when viewed in a direction orthogonal to the conductive flat plate member 12.

Also in the thus configured wireless communication structure, the conductive member 21 does not overlap the opening in the center of the conductive flat plate member 12 that surrounds the antenna 13 in plan view, and the conductive member 21 overlaps the conductive flat plate member 12 in plane view with the non-conductive member 22*b* functioning as a dielectric sandwiched in between. Therefore, the conductive member 21 and the conductive flat plate member 12 are assumed to be an electrically single member, the conductive member that interacts with the signal transmitted and received by the antenna 13 is assumed to be only the conductive flat plate member 12. Consequently, communication property of the antenna 13 is uniquely defined without being influenced by the external environment.

Preferably, the wireless communication structure may further include a protective film (not shown) for covering the first surface, which is opposite the second surface facing the base film 11, of the antenna 13. The protective film may have a shape capable of covering the antenna 13 and the conductive flat plate member 12.

While the embodiment in which the antenna 13 and the conductive flat plate member 12 shown in FIGS. 1 and 2 are directly attached to the body 2, which is to be detected, including the conductive member 21 and the non-conductive member 22*b* is shown in FIG. 7, obviously, various antennas and conductive flat plate members shown in FIGS. 3 to 5 may be directly attached to the body, which is to be detected, including the conductive member 21 and the non-conductive member 22*b*.

EXAMPLE

An example of a wireless communication structure according to the present invention will now be described.

In the present example, communication property (resistance and reactance property with respect to frequency) by the antenna 13 was analyzed on a calculator in a wireless communication structure in which the antenna unit 1 shown in FIG. 1 was attached to a disc shaped body 2, which is to be detected, including an aluminum deposition layer as the conductive member 21, and a wireless communication structure in which the antenna unit 1 was attached to the disc shaped body, which is to be detected, not including the conductive member 21.

Figure 8:
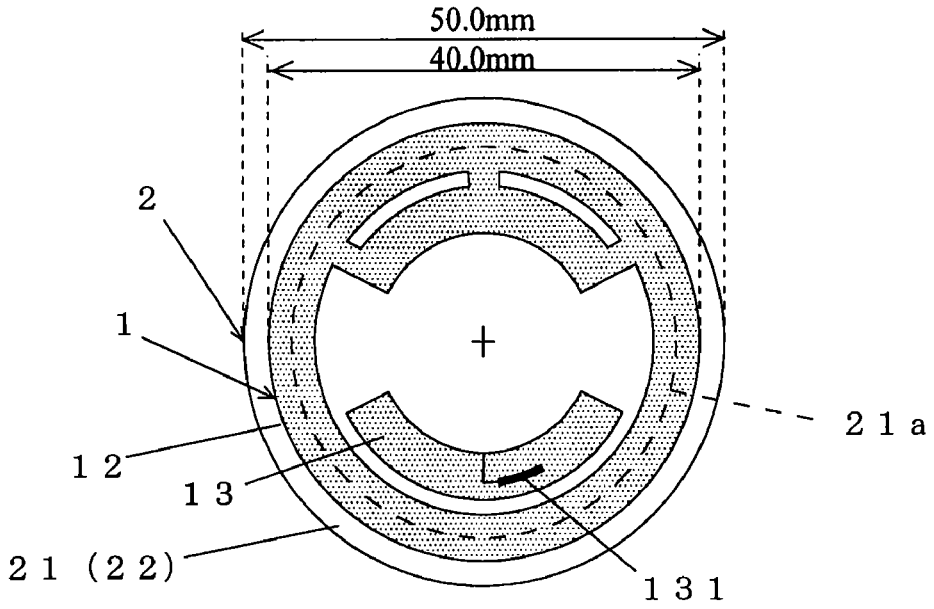
FIGS. 8(*a*) and 8(*b*) are a plan view and a side view of a wireless communication structure according to one example of the present invention, respectively.
Figure 8:
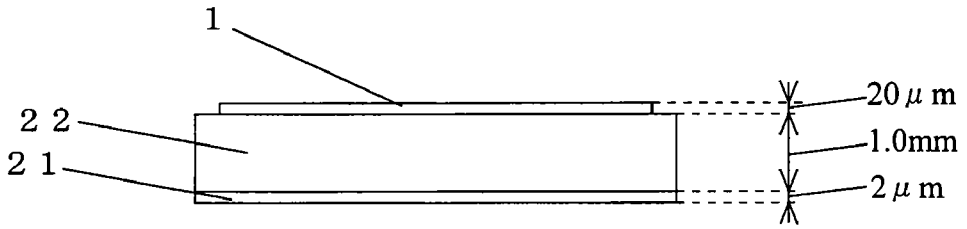

FIG. 8 shows the wireless communication structure used in the analysis of the present example, where the wireless communication structure is equipped with the antenna unit 1 and the body 2, which is to be detected, including the conductive member 21. FIGS. 8(*a*) and 8(*b*) are plan view and side view, respectively, of the wireless communication structure.

The antenna unit 1 and the conductive member 21 in the body to be detected 2 were made of aluminum, and a polycarbonate resin layer (having specific inductive capacity 29, and corresponding to the resin member 22 of the above embodiments) was interposed between the antenna unit 1 and the conductive member 21. Respective dimensions are as shown in FIG. 8.

In the body to be detected 2 of the wireless communication structure used in the present example, no resin layer was formed on a surface on a side, which is opposite to an attachment surface to which the antenna unit 1 is attached, of the conductive member 21. This was to simplify the analysis in view of the fact that the resin layer (reference number 22*a* in FIG. 2) positioned on the side, which is opposite to the surface on the side attached with the antenna unit 1, does not influence the communication property of the antenna unit 1.

The wireless communication structure not including the conductive member 21 had the same configuration as in FIG. 8 other than that the conductive member 21 was removed.

Figure 9:
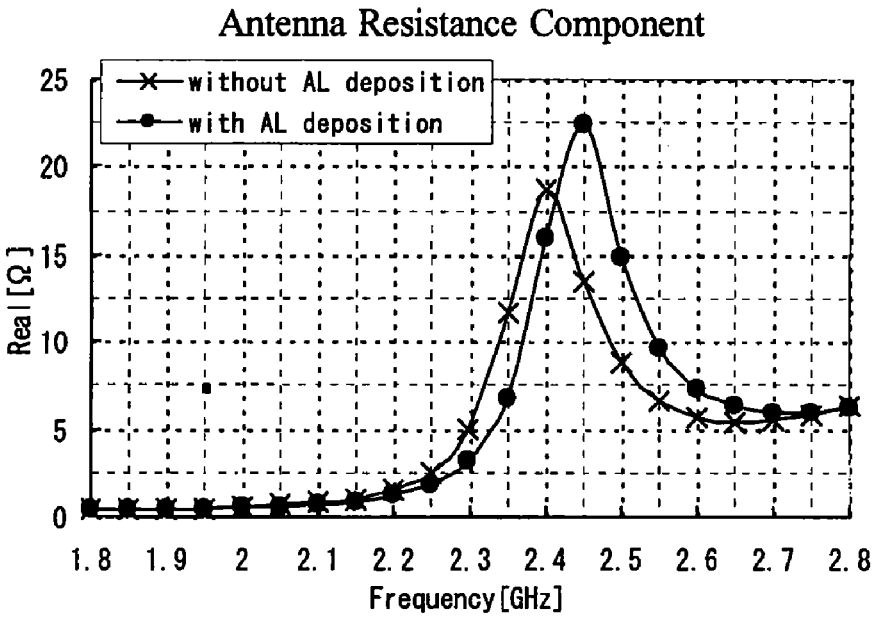
FIG. 9 is a graph showing an analysis result of the example of the present invention.
Figure 9:
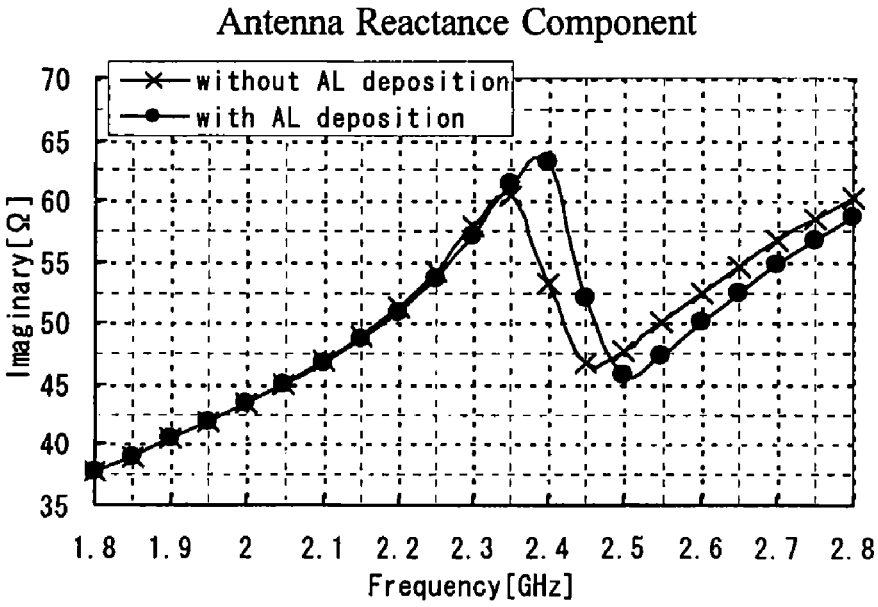

FIG. 9 shows an analysis result of the present example. FIG. 9(*a*) shows frequency-resistance component property, and FIG. 9(*b*) shows frequency-reactance component property.

As shown in FIG. 9(*a*), regarding the resistance component, a peak (resonance) frequency was 2.40 GHz in the wireless communication structure not including the conductive member 21, whereas the peak (resonance) frequency was 2.45 GHz in the wireless communication structure including the conductive member 21. Therefore, amount of shift therebetween was 0.05 GHz (measurement was carried out every 0.05 GHz in the present example. This is the same hereinafter).

As shown in FIG. 9(*b*), regarding the reactance component, the peak (resonance) frequency was 2.35 GHz in the wireless communication structure not including the conductive member 21, whereas the peak (resonance) frequency was 2.40 GHz in the wireless communication structure including the conductive member 21. Therefore, the amount of shift therebetween was 0.05 GHz.

COMPARATIVE EXAMPLES

As comparative examples, analysis similar to the above example was carried out on the wireless communication structure including the antenna 13 and not including the conductive flat plate member 12.

First, analysis was performed on the wireless communication structure (configuration in which the conductive flat plate member 12 is removed in the configuration shown in FIG. 8) in which the antenna 13 is dipole antenna.

Figure 10:
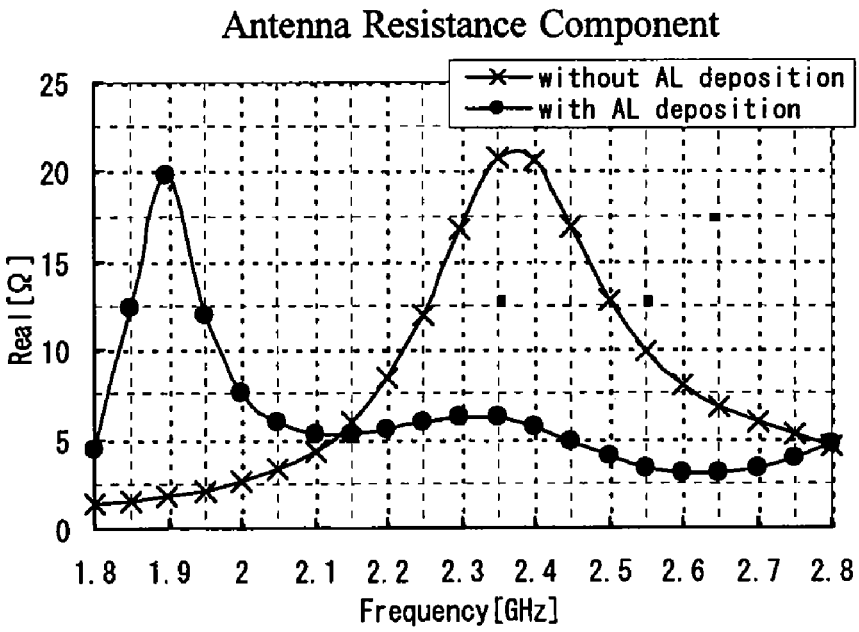
FIG. 10 is a graph showing an analysis result of a comparative example.
Figure 10:
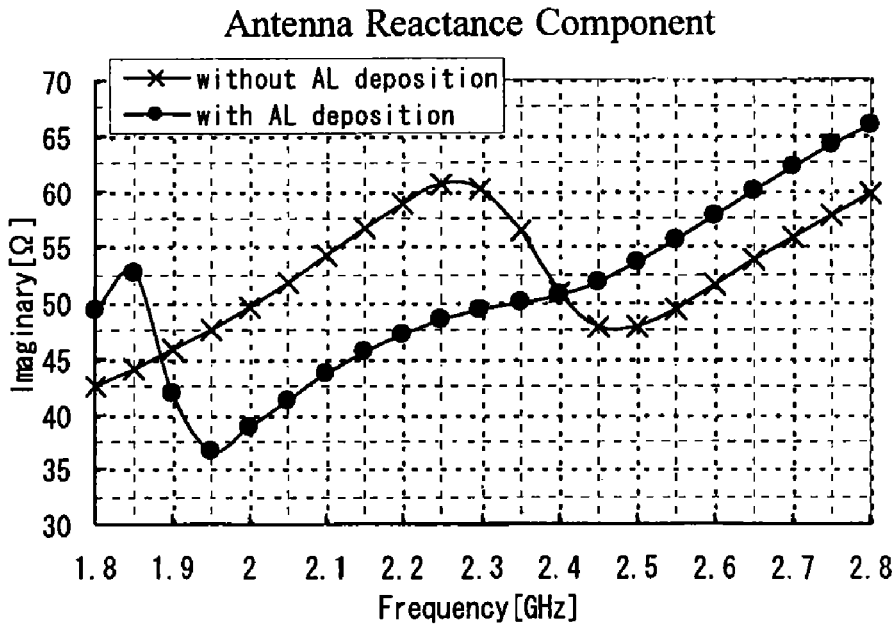

FIG. 10 shows an analysis result of the comparative example. FIG. 10(*a*) shows frequency-resistance component property, and FIG. 10(*b*) shows frequency-reactance component property.

As shown in FIG. 10(*a*), regarding the resistance component, a peak (resonance) frequency was 2.35 GHz in the wireless communication structure not including the conductive member 21, whereas the peak (resonance) frequency was 1.90 GHz in the wireless communication structure including the conductive member 21. Therefore, the amount of shift therebetween was 0.45 GHz.

As shown in FIG. 10(*b*), regarding the reactance component, the peak (resonance) frequency was 2.25 GHz in the wireless communication structure not including the conductive member 21, whereas the peak (resonance) frequency was 1.85 GHz in the wireless communication structure including the conductive member 21. Therefore, the amount of shift therebetween was 0.40 GHz.

Similar analysis was further performed on the wireless communication structure (having a configuration in which the conductive flat plate member 12 is removed from the antenna unit 5 of FIG. 4) in which the antenna 13 is a loop antenna in place of a dipole antenna.

Figure 11:
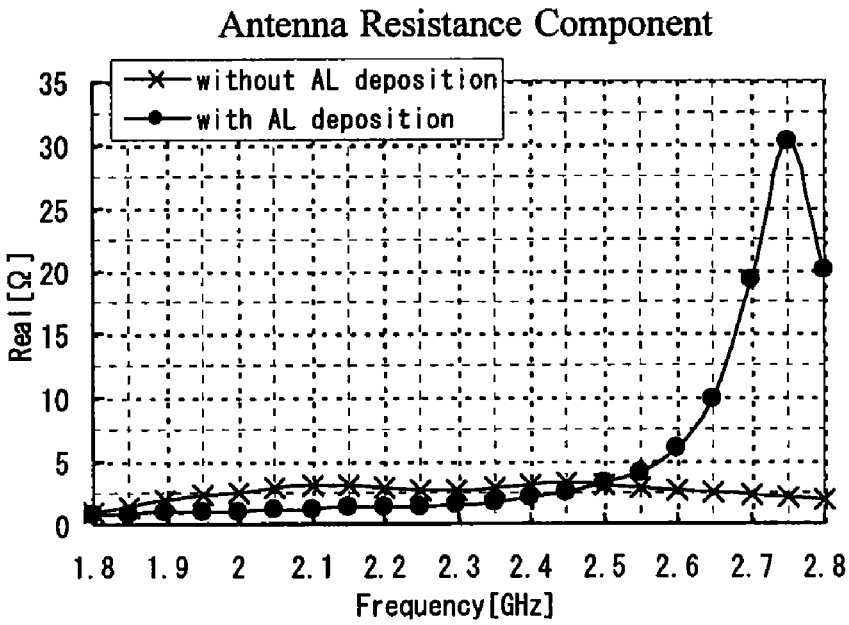
FIG. 11 is a graph showing an analysis result of another comparative example.
Figure 11:
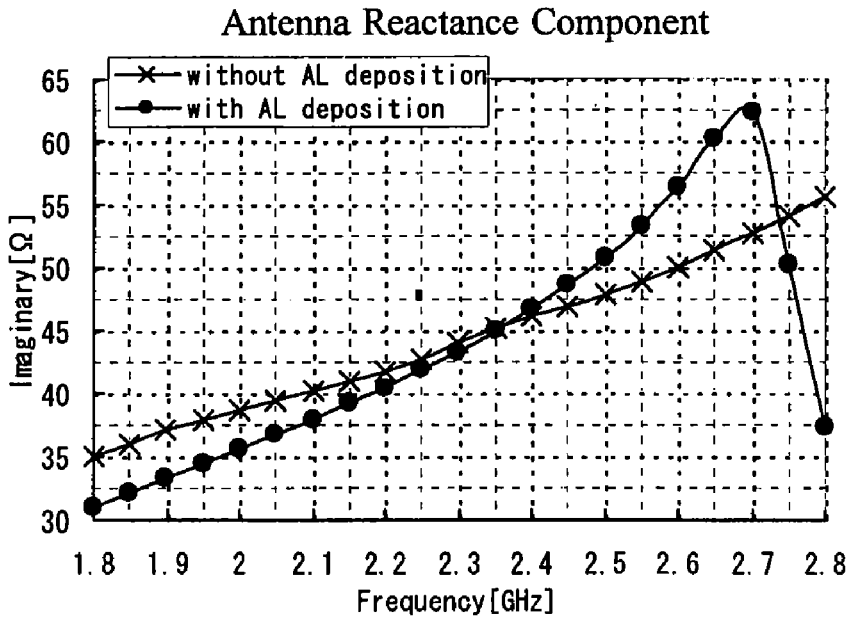

FIG. 11 shows an analysis result of such a comparative example. FIG. 11(*a*) shows the frequency-resistance component property, and FIG. 11(*b*) shows frequency-reactance component property.

As shown in FIG. 11(*a*), regarding the resistance component, the peak (resonance) frequency barely appeared within the measurement range in the wireless communication structure not including the conductive member 21, whereas an apparent peak appeared to a frequency of about 2.75 GHz in the wireless communication structure including the conductive member 21.

As shown in FIG. 11(*b*), regarding the reactance component, the peak (resonance) frequency barely appeared within the measurement range in the wireless communication structure not including the conductive member 21, whereas an apparent peak appeared to a frequency of about 2.70 GHz in the wireless communication structure including the conductive member 21.

Therefore, in the comparative examples, it was recognized that the amount of shift of the frequency peak indicating the resonance frequency more greatly changes between the presence/absence of the conductive member 21. It is thus apparent that the communication property of the antenna greatly changes due to the presence/absence of the conductive member 21 in the comparative examples.

In the example, on the other hand, it was recognized that change in amount of shift of the frequency peak indicating the resonance frequency was microscopic between the presence/absence of the conductive member 21. That is, it was recognized that the communication property of the antenna barely changes due to the presence/absence of the conductive member 21 in the configuration of the example. Therefore, the communication property of the antenna 13 could be uniquely determined without being influenced by the presence/absence of the conductive member 21 in the body to be detected 2 or another external conductive member according to the configuration in which the antenna 13 formed on a plane is surrounded by the conductive flat plate member 12, and the conductive member 21 overlaps the conductive flat plate member 12 in plan view with dielectric sandwiched in between while the conductive member 21 in the body 2 does not overlap the opening in the center of the conductive flat plate member 12 in plan view.

This specification is by no means intended to restrict the present invention to the preferred embodiment and the modified embodiment set forth therein. Various modifications to the antenna unit, the wireless communication structure and the antenna structure may be made by those skilled in the art without departing from the spirit and scope of the present invention as defined in the appended claims.

What is claimed is:

1. An antenna unit capable of being attached to a detected body that includes a conductive member and resign layers sandwiching the conductive member, the antenna unit comprising:

a non-conductive base film that includes a first surface and a second surface facing an opposite side to the first surface and that is attached to the resign layer of the detected body at the second surface;

an endless conductive flat plate member attached onto the first surface of the base film and having an opening in a center thereof;

a dipole antenna attached to the first surface of the base film so as to be positioned in the opening of the conductive flat plate member in a state of being isolated from the conductive flat plate member by having a gap formed between the dipole antenna and an inner circumferential edge of the conductive flat plate member; and an IC tip attached onto the dipole antenna, wherein the antenna unit is capable of being attached to the detected body so that, as viewed in a direction orthogonal to the conductive flat plate member, the conductive member of the detected body is not positioned in the opening in the center of the conductive flat plate member and is overlapped with the conductive flat plate member, and wherein the dipole antenna and the conductive flat plate member have resonance frequencies that are different from each other.

2. The antenna unit according to claim 1, wherein the conductive flat plate member includes an annular portion having a circular shape in plane view, and an equilibrium portion arranged substantially symmetrically to the dipole antenna with a center of the annular portion as a reference, and the equilibrium portion is either electrically connected with the annular portion, or split into small pieces not so as to affect the resonance frequency transmitted and received through the antenna.

3. The antenna unit according to claim 2, wherein the antenna is configured so that the gap between the antenna and the inner circumferential edge of the annular portion is substantially constant across the circumferential direction.

4. A wireless communication structure comprising:

a disk shaped body that is to be detected and rotates around a rotational axis, the body including an endless conductive member that is arranged coaxially with the rotational axis and has an opening in a center thereof;

an endless conductive flat plate member attached to the body with a resign layer being inserted between the conductive flat plate member and the conductive member, the conductive flat plate member having an opening in a center thereof;

a dipole antenna attached to the body so as to be positioned in the opening of the conductive flat plate member in a state of being isolated from the conductive flat plate member by having a gap formed between the dipole antenna and an inner circumferential edge of the conductive flat plate member; and an IC tip attached onto the dipole antenna, wherein the conductive flat plate member is attached to the body so that, as viewed in a direction orthogonal to the conductive flat plate member, the conductive member of the body is not positioned in the opening in the center of the conductive flat plate member and is overlapped with the conductive flat plate member, and wherein the dipole antenna and the conductive flat plate member have resonance frequencies that are different from each other.

5. The wireless communication structure according to claim 4, wherein the conductive flat plate member includes an annular portion positioned coaxially with the rotational axis and an equilibrium portion arranged substantially symmetrically to the dipole antenna with the rotational axis as a reference, and the equilibrium portion is either electrically connected with the annular portion, or split into small pieces not so as to affect the resonance frequency transmitted and received through the antenna.

6. The wireless communication structure according to claim 4, wherein the conductive flat plate member includes an annular portion positioned coaxially with the rotational axis and a wide width portion extending radially inward from the annular portion at an area other than a region where the dipole antenna is positioned with respect to a circumferential direction with the rotational axis as a reference, a terminating end portion of the wide width portion in the circumferential direction faces a terminating end of the dipole antenna in the circumferential direction with a gap having the same width as the gap between the dipole antenna and the inner circumferential edge of the conductive flat plate member, and the wide width portion has an inner circumferential edge having the same diameter as the inner circumferential edge of the dipole antenna.

7. The wireless communication structure according to claim 4, wherein the conductive flat plate member includes an annular portion positioned coaxially with the rotational axis and a wide width portion extending radially inward from the annular portion at an area substantially symmetric to the dipole antenna with the rotational axis as a reference.

8. The wireless communication structure according to claim 4, wherein the conductive flat plate member is attached to the body that is to be detected so as to cross over the inner circumferential edge of the conductive member across an entire circumferential region when seen along the rotational axis.

9. An antenna structure applied to a disk shaped body that is to be detected, the body being capable of rotating around a rotational axis and including an endless conductive member that is arranged coaxially with the rotational axis and that has an opening in a center thereof, and a resign layer for covering at least a first surface on one side of the conductive member, the antenna structure comprising:

an endless conductive flat plate member attached to the resign layer of the body and having an opening in a center thereof;

a dipole antenna attached to the resign layer of the body so as to be positioned in the opening in the center of the conductive flat plate member in a state of being isolated from the conductive flat plate member by forming a gap between the dipole antenna and the inner circumferential edge of the conductive flat plate member; and an IC tip attached onto the dipole antenna, wherein the conductive flat plate member attached to the body so that, as viewed in a direction orthogonal to the conductive flat plate member, the conductive member of the body is not positioned in the opening in the center of the conductive flat plate member and is overlapped with the conductive flat plate member, and wherein the dipole antenna and the conductive flat plate member have resonance frequencies that are different from each other.

10. The antenna structure according to claim 9, wherein the conductive flat plate member and the dipole antenna are laminated on a non-conductive base file so as to form an antenna unit; and the conductive flat plate member and the dipole antenna are attached to the resign layer of the body via the base film.

11. The antenna structure according to claim 9, wherein an overlapping area of the conductive flat plate member and the conductive member when seen along the rotational axis has a constant width with respect to a radial direction with the rotational axis as a reference over the entire circumferential region around the rotational axis.

12. The antenna structure according to claim 9, wherein the gap between the dipole antenna and the inner circumferential edge of the conductive flat plate member has a constant width around the rotational axis.

* * * * *